United States Patent [19]

Lapp et al.

[11] Patent Number: 5,003,687

[45] Date of Patent: Apr. 2, 1991

[54] OVERMODED WAVEGUIDE ELBOW AND FABRICATION PROCESS

[75] Inventors: Roger H. Lapp, Silver Spring; Theodore F. Paraska, Clarksville, both of Md.

[73] Assignee: The Johns Hopkins University, Baltimore, Md.

[21] Appl. No.: 194,364

[22] Filed: May 16, 1988

[51] Int. Cl.[5] ..... H01P 11/00

[52] U.S. Cl. ..... 29/600; 29/458; 29/460; 29/527.2; 29/527.4; 156/173

[58] Field of Search ..... 29/600, 458, 460, 469.5, 29/527.2, 527.4; 427/163; 156/171, 173, 175, 143, 169; 333/242; 264/317, 221

[56] References Cited

U.S. PATENT DOCUMENTS 3,020,615 2/1962 Peters ..... 29/458

3,078,428 2/1963 Miller ..... 333/242

OTHER PUBLICATIONS

"Waveguide Design and Fabrication", Boyd et al, vol. 56, No. 10, Dec. 1977, The Bell System Technical Journal.

*Primary Examiner*—Joseph M. Gorski

*Attorney, Agent, or Firm*—Robert E. Archibald

[57] ABSTRACT

A process for fabricating a sheathed-helix circular overmoded waveguide bend comprised of an inner helical wound insulated wire, a dielectric lining, and an outer conductor layer surrounding the dielectric lining. The inner winding is wound on a removable hollow rigid core, the dielectric liner or sheath is then molded onto the outer surface of the winding, and outer conductor is then attached to the outer surface of the dielectric liner. The core is made removable (from the helix winding) by coating it with a low melt temperature alloy which is melted by passing hot water through the hollow core.

13 Claims, 3 Drawing Sheets

OVERMODED WAVEGUIDE ELBOW AND FABRICATION PROCESS

STATEMENT OF GOVERNMENTAL INTEREST

This invention was made with Government support under contract No. N00024-85-C-5301 awarded by the U.S. Navy Department. The Government has certain rights in this invention.

BACKGROUND OF THE INVENTION

It is well-known that standard or fundamental waveguide is severely restricted in maximum power capacity and in minimum loss because of its required cross sectional dimensions. It is also well-known that overmoded waveguide has the advantages that it can be designed to have arbitrarily high power capacity and arbitrarily low attenuation by appropriately increasing the waveguide cross section. In overmoded waveguide, the required suppression of unwanted modes is achieved using dielectric and metallic structures to restrict unwanted allowable modes (e.g. see "Trunk Waveguide Communication" by A. E. Karbowiak, Chapmen and Hall, Ltd., London, 1965). Overmoded waveguide have been utilized as telecommunications trunk transmission lines and to connect transmitters to communications or radar antennas.

The most common type of overmoded waveguide supports the circular $TE_{01}$ mode which has the unique property of decreasing transmission loss with increasing frequency for a given diameter. Circular overmoded waveguide can take the form of a plain metallic waveguide, metallic waveguide with a dielectric liner, or a sheathed-helix waveguide consisting of a closely wound insulated wire surrounded by a dielectric layer encapsulated by a good conductor. Various processes have been proposed for fabricating helical waveguide structures; examples are disclosed in U.S. Pat. Nos. 3,605,046, 4,043,029, 4,066,987, 4,071,834, and 4,090,280. However, one significant problem associated with the practical application of circular overmoded waveguide is the need for an elbow structure which is efficient and practical for overmoded circular waveguide applications, and which can be fabricated in a feasible manner in practical sizes and configurations.

SUMMARY OF THE INVENTION

The present invention relates generally to a waveguide elbow structure and its novel method of fabrication, and particularly to an elbow useful for practical applications of circular overmoded waveguide. In accordance with the preferred embodiment of this invention, the elbow is fabricated as a sheathed-helix waveguide by a process which has been successfully used in practice to construct overmoded waveguide elbows suitable for use at X-band (approximately 2.5 inches inside diameter) and at S-band (approximately 6 inches inside diameter). The overall design goal was to provide for 6–10 MW peak power handling capability at S-band with continuous operating temperatures of 150° C. and no cooling water for the component materials. A close tolerance was maintained on the circularity and positioning of the internal helical winding, as well as the roundness and uniform thickness of the adjacent dielectric.

One object of the present invention is to provide a method for fabricating an overmoded waveguide elbow structure.

Another object of the invention is to provide a method for fabricating an overmoded waveguide elbow structure as a sheathed-helix waveguide consisting of an internal, closely wound insulated wire surrounded by a dielectric layer encapsulated by an outer conductor.

Other objects, purposes and characteristic features of the present invention will be pointed out as the description of the invention progresses and/or be obvious from the accompanying drawings wherein.

DETAILED DESCRIPTION OF THE INVENTION

Figure 1:
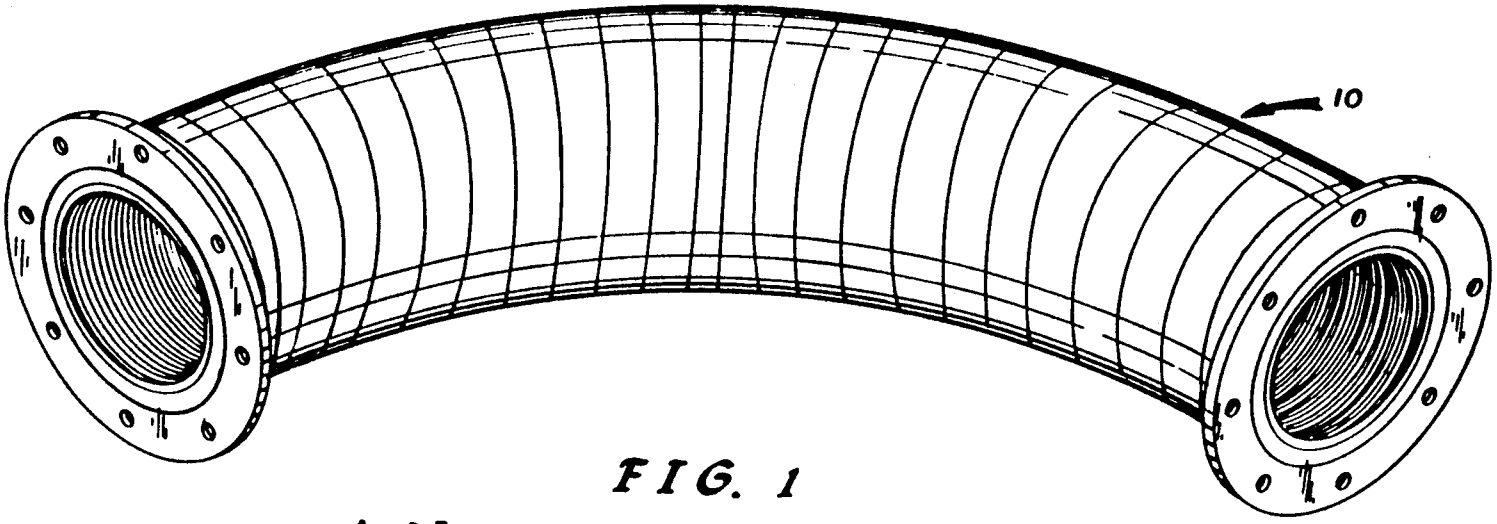
FIG. 1 illustrates a completed waveguide elbow fabricated in accordance with the present invention.
Figure 2:
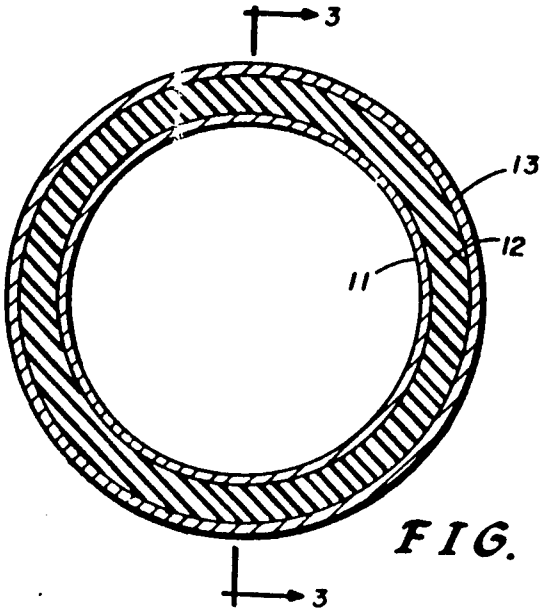
FIG. 2 is a simplified cross sectional view of the waveguide elbow showing the basic components thereof.
Figure 3:
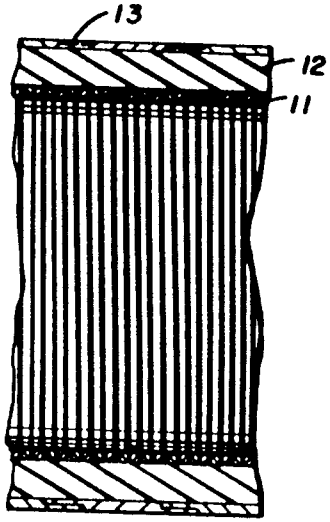
FIG. 3 is a partial side view taken along line 3—3 in FIG. 2.

As discussed above, the present invention relates to circular overmoded waveguide and, in particular, to the fabrication of a sheathed-helix waveguide elbow designed for overmoded operation. FIG. 1 illustrates the completed elbow structure 10; whereas, FIGS. 2 and 3 show the basic components of the elbow as comprising an internal helical wound insulated wire 11, a dielectric sheath or layer 12, and an external encapsulating conductor 13.

Figure 4:
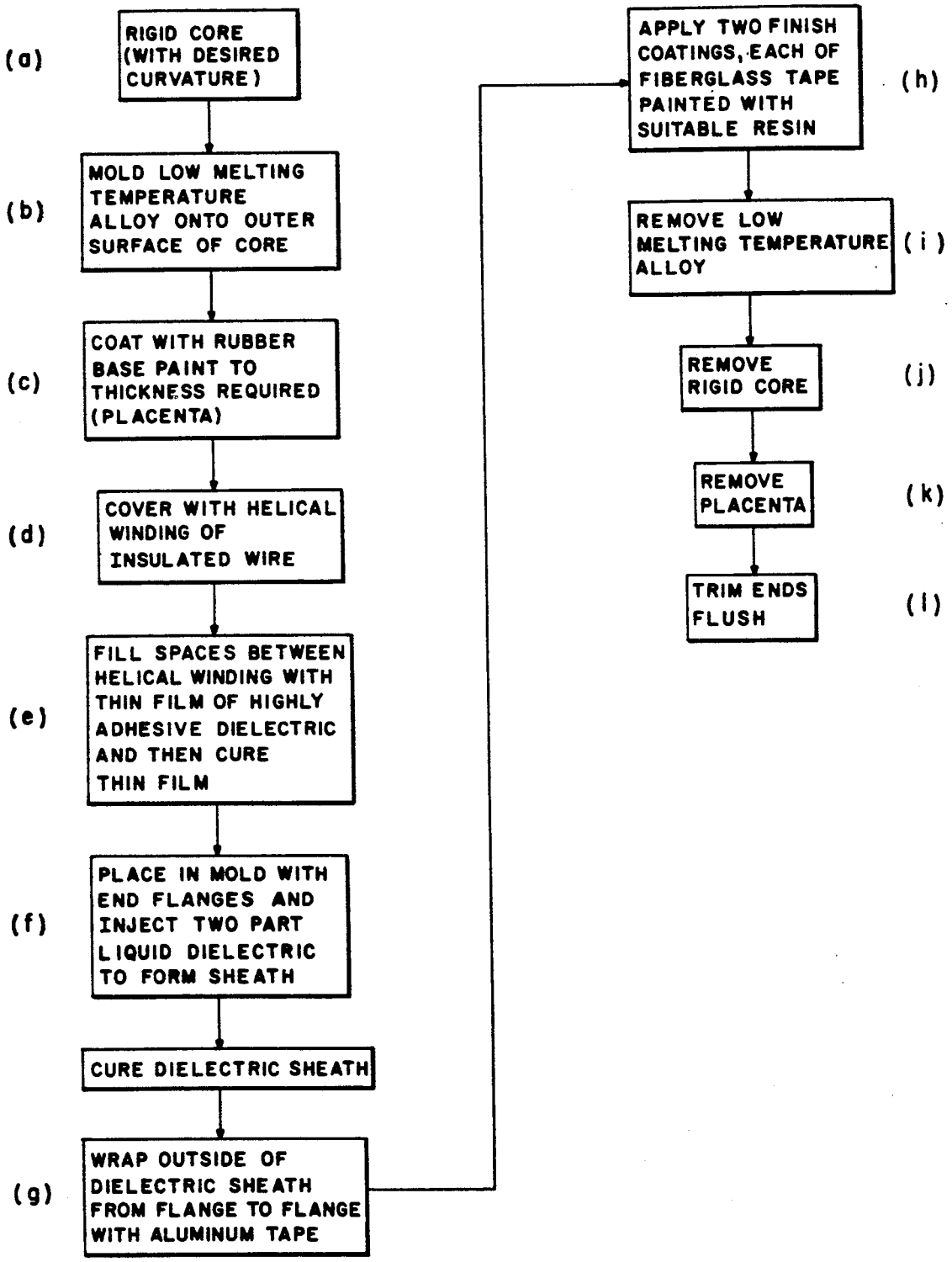
FIG. 4 is a block diagram illustrating the preferred embodiment of the fabrication process proposed in accordance with the present invention.
Figure 5A:
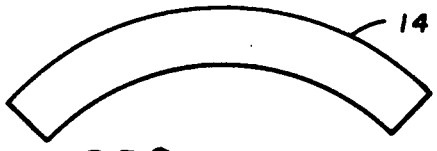
FIG. 5 is a diagrammatic illustration of the various fabrication steps comprising the preferred embodiment of the invention.
Figure 5B:
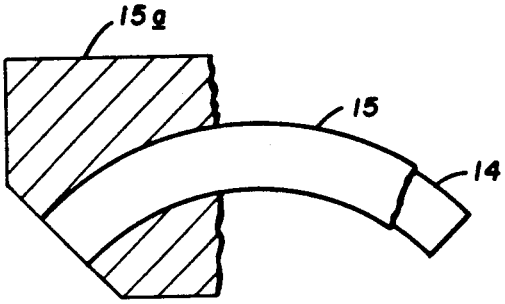
Figure 5C:
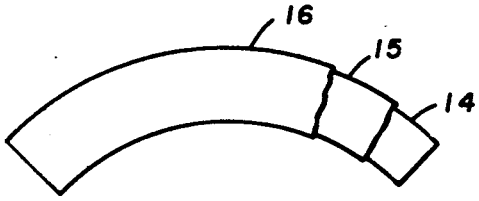
Figure 5D:
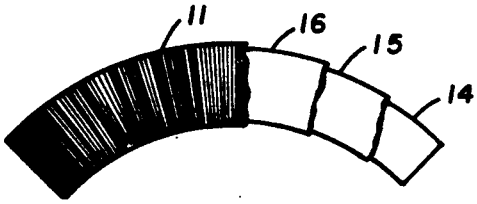
Figure 5E:
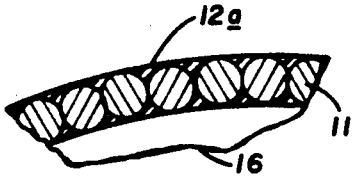
Figure 5F:
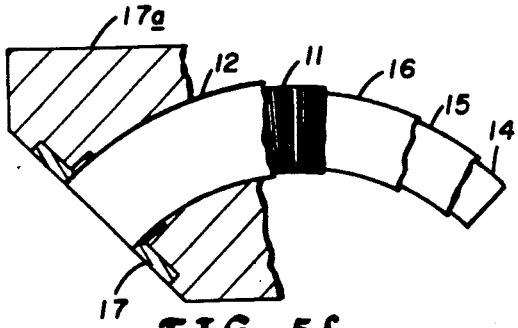
Figure 5G:
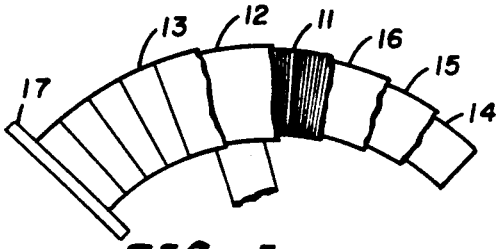
Figure 5I:
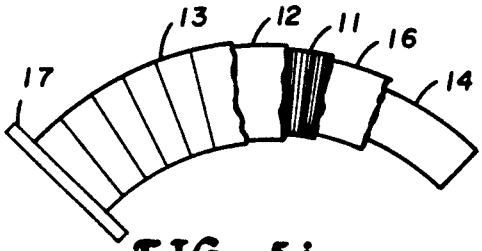
Figure 5J:
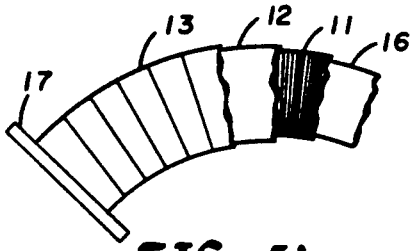
Figure 5K:
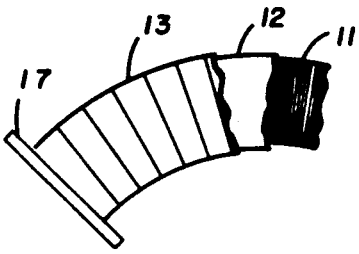

The process by which the sheathed-helix waveguide elbow of FIG. 1 is fabricated, in accordance with the presently preferred embodiment of the invention, is illustrated in FIGS. 4 and 5 of the drawings. Referring simultaneously to FIGS. 4 and 5, at (a), the proposed process begins with a suitable rigid core 14. In practical application of the process, to fabricate an X-band elbow having an inside diameter of approximately 2 and ½ inches, the rigid core 14 comprised a flexible metal bellows; whereas, for fabricating an S-band elbow having an inside diameter of about 6 inches, the core 14 was constructed of short pieces of hollow pipe bolted end-to-end for the desired length of elbow. The core 14 is made hollow so that hot water can be passed through the core as will be discussed later. In step two of the process, as shown at (b), a coating of low melting temperature alloy 15 such as Woods Metal (158° F.) is molded onto the outer surface of the core 14. This might be accomplished in a suitable mold 15*a* of cornu bend configuration, having a continuously variable radius of bend.

To prevent adhesion of the alloy 15 to the insulated helical wound wire (reference 11 in FIG. 2 and 3), the alloy 15 is first coated with a suitable rubber-base paint to form a placenta-like skin 16 of suitable thickness (reference (c) in FIGS. 4 and 5). The next step (d) in the process involves helically winding the insulated wire onto the form. This step preferably is performed such that each turn of wire is perpendicular to the centerline of the waveguide structure. To accomplish this, a novel constant tension wire winding device was invented by one of the present inventors and is disclosed in detail in copending and commonly assigned U.S. patent application Ser. No. 115,291 filed Nov. 2, 1987.

Following the wire winding step, it was found desirable to first coat the outer surface of the helical wire with a highly adhesive dielectric material such as grey RTV to assure a good bond between the winding and the subsequently applied RTV dielectric sheath. This is represented at step (e) in FIG. 5 where the highly adhesive dielectric, designated at 12*a*, is applied as a thin film to fill any spaces between the winding and then screed off flush with the outer surface of the helical wire 11. After the dielectric layer 12*a* has cured, flanges 17 are attached to the ends of the bend structure and the structure is placed in a second mold 17*a*, where a selected liquid dielectric material is molded, at step (f), onto the helical wire. In FIGS. 2 and 3, the dielectric is referenced generally at 12. In the practical application referred above, the dielectric layer or sheath 12 is formed of two part liquid RTV which is injected under pressure into the mold 17*a* surrounding the insulated helical wire winding. To assure circularity and uniform thickness of the dielectric sheath 12 and angular coverage of the elbow, the helical wire wound structure is mounted concentrically in the mold 17*a* with the flanges 17; e.g. by suitable chaplets formed of solid RTV disposed at selected locations along the length of the wound structure to support it centered in the mold. Preferably, the RTV was deaerated prior to injection into the mold 17*a*, to assure a uniform density.

The layer 12 is then cured, to form a solid dielectric layer surrounding the helical wire.

At this stage in the proposed process, an appropriate metallic conductor skin 13 is placed on the outer surface of the structure along the entire length of the bend, from flange to flange. In the practical application referred to above, this outer conductor 13 (step (g)) was formed by wrapping aluminum foil around the outside of the dielectric layer. The outer metallic skin 13 need not be very thick so long as good electrical conductivity is achieved along the length of the bend's outside conductor from flange to flange. It was found that wrapping a sticky-back aluminum tape overlapped approximately 50% was adequate. As a finishing, two fiberglass and resin layers (step (h)) FIG. 4 were applied over the aluminum foil skin.

As illustrated in FIGS. 4 and 5, the core 14 is removed by first melting and removing the low melt temperature alloy, at step (i). This was accomplished by simply running hot water through the center of the hollow core and then pouring out the molten alloy. The core 14 is thereby freed for removal as depicted at step (j) in FIG. 5. Finally, the placenta 16 is removed at step (k) and, following any necessary trimming of the ends (step (1)) FIG. 4, the illustrated process is complete.

Obviously, various modifications and alterations to the above-described process are possible in light of the foregoing discussion, and therefore, within the scope of the appended claims, the invention may be practiced otherwise than as specifically shown and described hereinabove.

What is claimed is:

1. A method for fabricating a circular waveguide elbow section comprising the steps of:

providing a removable rigid core form having the elbow curvature desired;

coating said core form with a low melt temperature material;

applying a helical winding of insulated wire onto the outer surface of the coated core form;

molding a lining of dielectric material onto the outer surface of said helical winding;

attaching an electrically conductive layer to encapsulate the outer surface of said dielectric lining; and withdrawing said rigid core form by melting said low melt temperature material by applying heat to said low melt temperature material to release said core form from said winding.

2. The fabrication method specified in claim 1, further comprising the step of coating the low melt temperature material with a rubber base paint prior to applying said helical winding to prevent adhesion between said winding and said low melt temperature material.

3. The fabrication method specified in claim 1, wherein said rigid core form is hollow and the step of melting said low melt temperature material involves passing hot water through said hollow rigid core form to melt said material.

4. The fabrication method specified in claim 3, wherein said low melt temperature material is an alloy of selected low melt temperature such as Woods Metal (melt temperature 158° F.).

5. The fabrication method specified in claim 1, wherein the step of molding a dielectric lining onto said helical wire comprises applying a relatively thin first layer of adhesive dielectric material to the outer surface of the helical wire and then molding a relatively thick second layer of dielectric material onto said first layer.

6. The fabrication method specified in claim 1, wherein the step of molding said lining of dielectric material onto said helical wire comprises the sequential steps of positioning said curved wire-wound core concentrically in a mold of like curvature, injecting a liquid dielectric material into said mold to obtain a uniform layer of constant thickness and constant circular cross-section, and curing said liquid dielectric material to a solid.

7. The fabrication method specified in claim 6 further including the step of attaching flange means to the ends of said circular waveguide elbow section.

8. The fabrication method specified in claim 7 wherein the step of attaching said flange means is accomplished by mounting said flange means concentrically within said mold of like curvature prior to the step of injecting said liquid dielectric material to assure the angular extent of flange to flange curvature.

9. The fabrication method specified in claim 8 wherein the step of attaching said outer electrically conductive layer comprises wrapping an adhesive aluminum tape about the outer surface of said dielectric lining to electrically connect together said end flange means.

10. The fabrication method specified in claim 6 wherein the step of molding said dielectric lining onto said removable rigid core form takes place in a mold having a cornu bend curvature having a variable bend radius.

11. The fabrication method specified in claim 1 wherein the step of attaching said outer electrically conductive layer comprises wrapping an adhesive aluminum tape about the outer surface of said dielectric lining and further including the step of applying fiberglass to the outer surface of said aluminum tape to provide stiffness.

12. The fabrication method specified in claim 1 wherein the step of providing said removable rigid core comprises providing a metallic bellows of selected diameter and configured to have said desired curvature.

13. The fabrication method specified in claim 1 wherein the step of providing said removable rigid core comprises providing a plurality of curved metallic pipe segments connected end-to-end.

* * * * *